United States Patent [19]

Fraga

[11] Patent Number: 4,600,398

[45] Date of Patent: Jul. 15, 1986

[54] SPINNING TOY

[76] Inventor: Cornelio Fraga, 6329 Casitas Ave., Bell, Calif. 90201

[21] Appl. No.: 655,770

[22] Filed: Oct. 1, 1984

[51] Int. Cl.[4] ..... A63H 1/02

[52] U.S. Cl. ..... 446/240

[58] Field of Search ..... 446/236, 238, 239, 240, 446/255, 256, 259, 264, 262, 263, 266, 396, 450; 74/438, 436

[56] References Cited

U.S. PATENT DOCUMENTS

| | | | |
|---|---|---|---|
| 476,825 | 6/1892 | Schwartz | 446/240 |
| 2,112,444 | 3/1938 | McFarlin | 446/240 |
| 3,141,262 | 7/1964 | Burton | 446/240 |
| 4,096,659 | 6/1978 | Keane | 446/240 |
| 4,112,611 | 9/1978 | Kernell | 446/240 |
| 4,337,672 | 7/1982 | Shiber | 74/438 |

*Primary Examiner*—Robert A. Hafer
*Assistant Examiner*—D. Neal Muir

[57] ABSTRACT

This toy consists of a spinning disk with central dome and a wand. The wand has a tip to engage inwardly oriented teeth near the edge of the central dome to prohibit withdrawal of the wand from the disk until the disk has been allowed to freely rotate upon the tip of the wand. Each tooth is arranged to engage the wand tip as the wand propels the disk in angular acceleration yet release the wand tip to allow the disk to freely rotate upon the wand tip when the tip is at the apex of the central dome. After this free spinning is obtained, the disk may be thrown or used by itself in other stunts.

19 Claims, 12 Drawing Figures

A
A
3
3
2
2
10
12
14
16
18
20
22
24
26
28
30
32
34
36
38
40
50
52
54
56

FIG. 4
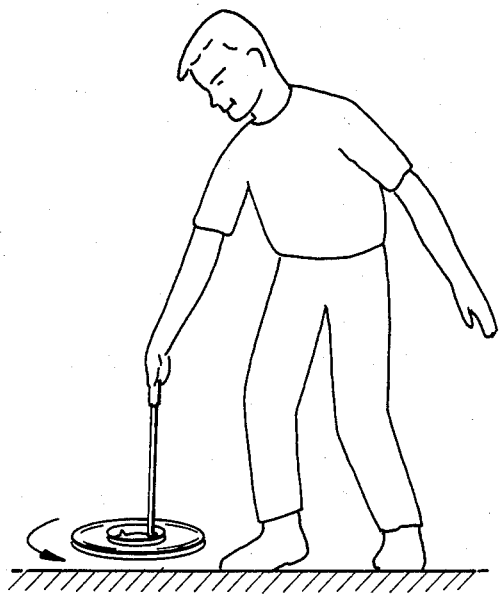
FIG. 6
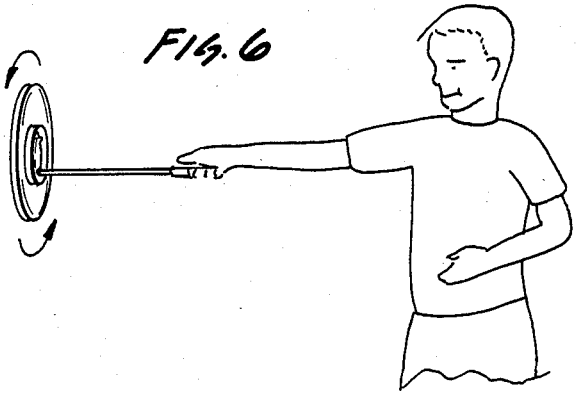
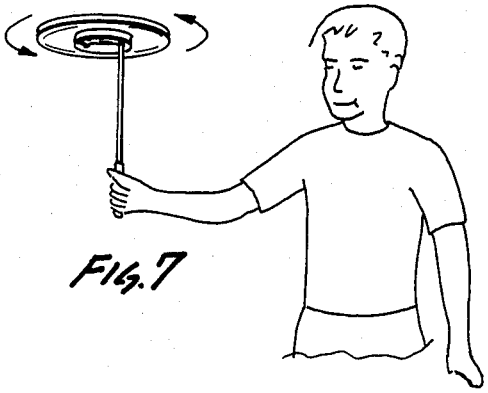
FIG. 7
FIG. 5
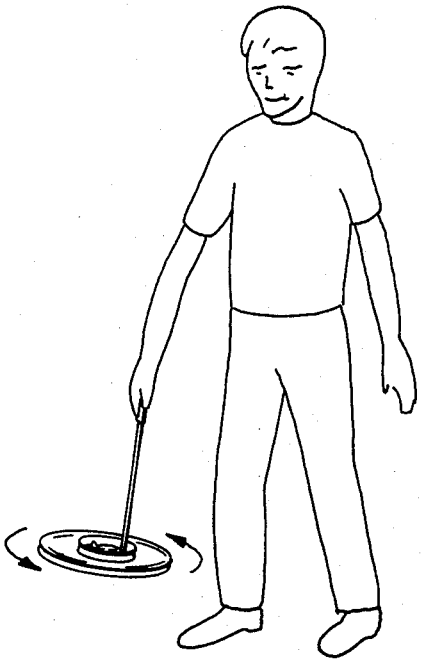
FIG. 8
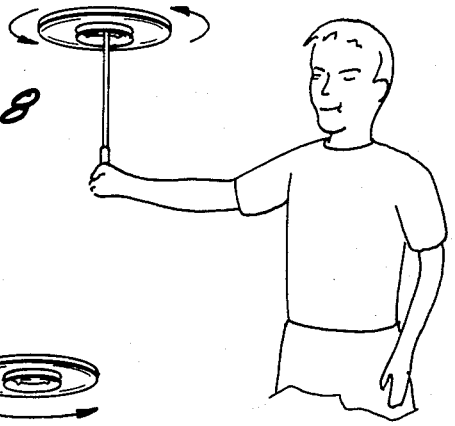
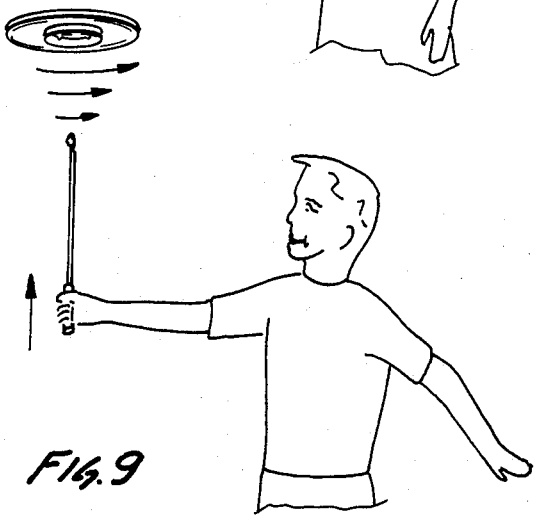
FIG. 9

SPINNING TOY

BACKGROUND OF THE INVENTION

1. FIELD OF THE INVENTION

The present invention pertains to the field of games and toys, and is more particularly directed to a toy requiring skill and physical coordination consisting of a disk and a wand for manipulating the disk so as to make it spin in different attitudes.

2. STATE OF THE PRIOR ART

Applicant is not aware of toys or amusement devices similar to the present invention. A well known flying disk marketed under the Frisbee(R) name differs from the present invention in that it is meant for manual use, and is not constructed for use with a wand in the manner which will be described below.

SUMMARY OF THE INVENTION

The amusement device of this invention comprises a rotor body having an axis of rotation, and provided with a series of tooth elements disposed in a circular arrangement concentric with the axis of rotation. The toy also comprises a wand removably engageable with any one of the tooth elements for imparting a spin to the rotor body by moving the wand in a circular trajectory.

The rotor body may have a concavity defined in its underside and shaped so as to include an apex aligned with the rotor body's axis of rotation of thereby allow the rotor body to be balanced on and supported by the end of the wand.

The wand a tip configured so as to be movable into and out of engagement with the tooth elements by movement of the tip generally within the plane occupied by the circular arrangement of tooth elements, but which tip is locked against withdrawal in a direction transverse to this plane while the tip is engaged with one of the tooth elements.

In a presently preferred embodiment, the rotor body is a circular disk with a central dome on the topside of the disk defining a dome cavity open on the underside of the disk. A number of evenly spaced tooth elements extend towards the center of the disk in a ring arrangement within the dome cavity. The ring of tooth elements lies in a plane parallel to the normal plane of rotation of the disk. Each tooth element has a leading edge, a trailing edge, and a notch for receiving the tip of the wand. The configuration of the tooth elements defined a characteristic sense of rotation of the disk, i.e., either clockwise or counterclockwise. Each notch is shaped such that the tip of the wand is received therein and positively engages the tooth element when urged against its trailing edge so as to transmit circular motion of the wand tip to the rotor body, but also allows the wand to readily move out of the notch towards the center of the disk. The leading edge of each tooth element is ramped inwardly so as to deflect the wand tip towards the center of the dome cavity and away from engagement with the tooth element such that the rotation of the disk is not substantially hindered upon contact of the wand tip with a leading edge. This tooth configuration permits a free wheeling effect of the rotor body wherein the rotor body disengages from the wand and continues to spin freely even after positive force is no longer transmitted through the wand to a tooth element. Conversely, the leading edges are ramped so as to guide the wand tip into a notch when the want tip is moved radially outwardly within the dome cavity into engagement with the ring of tooth elements.

The aforementioned characteristics allow the rotor body to be spun by the wand in a variety of attitudes and through an assortment of aerobatic stunts of varying complexity and degree of difficulty. The toy of this invention is thus interesting and challenging to children and adults alike, and to persons possessed of widely different levels of skill and coordination.

The toy may be used by a single individual for private amusement, as well as being suitable for team play between two or more individuals, wherein the disk is thrown from one individual to another person who must catch it on the end of his or her wand without interrupting the rotation of the disk. Many games and stunts can be developed around the toy of this invention beyond those disclosed and illustrated in the present specification.

BRIEF DESCRIPTION OF THE DRAWINGS

FIG. 4 illustrates a typical player spinning the disk upside down on a ground surface with the wand.

FIG. 5 illustrates the spinning disk raised off the ground surface of FIG. 4 and held upside down at the end of the down-turned wand.

FIG. 6 illustrates the disk spinning in a vertical plane at the end of the horizontally held wand.

FIG. 7 illustrates the disk spinning in a horizontal right-side up position at the end of the vertically held wand.

FIG. 8 shows the disk spinning freely while supported at its central apex on the tip of the wand.

FIG. 9 illustrates the spinning disk thrown into the air and separated from the wand.

DETAILED DESCRIPTION OF THE PREFERRED EMBODIMENT

Figures 1, 2, 3:
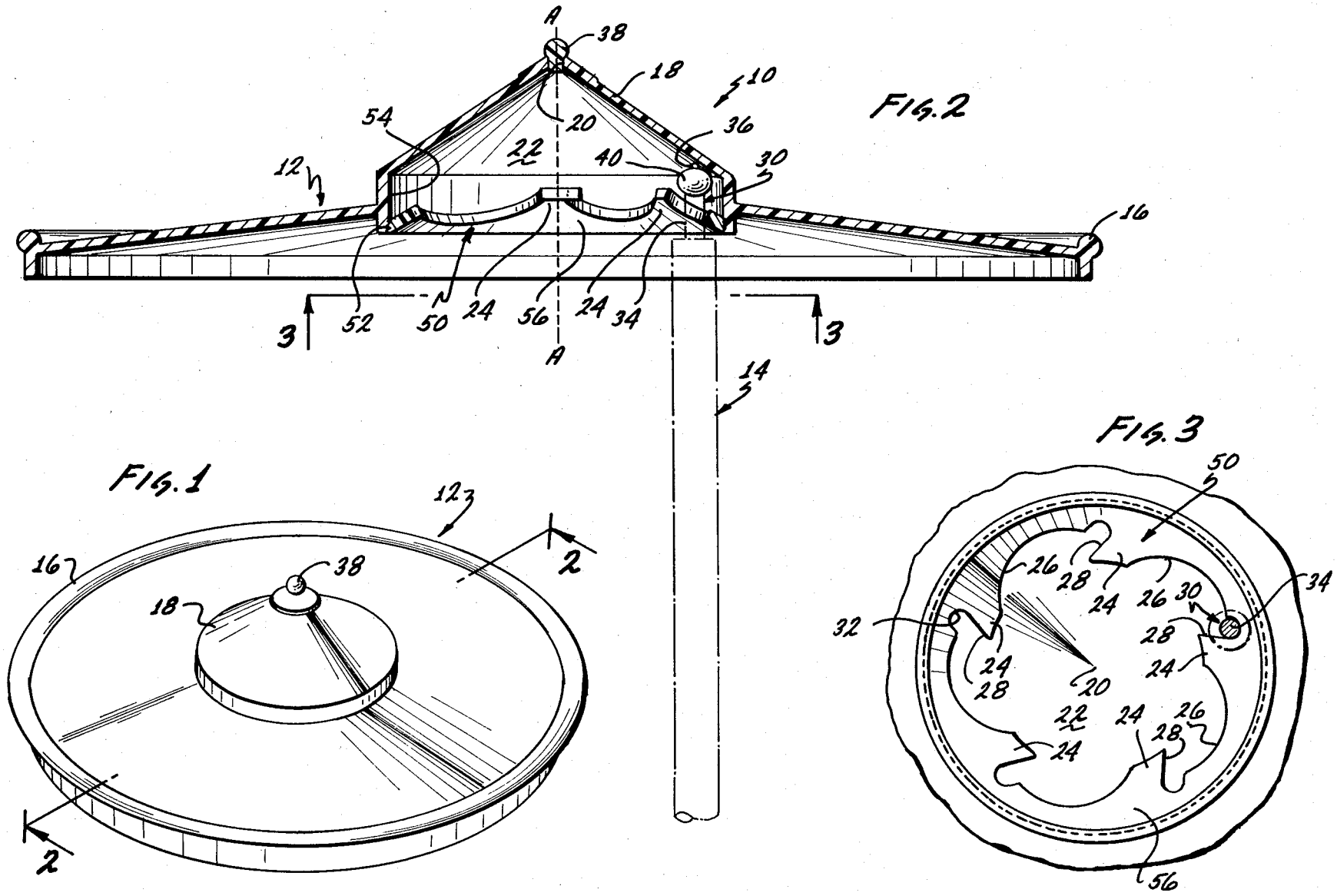
FIG. 1 is a top perspective view of the disk used in the novel toy.
FIG. 2 is a cross section taken in elevation along line 2—2 in FIG. 1, and showing in ghost lining the wand tip in engagement with a tooth element of the disk.
FIG. 3 is a bottom plan view of the center portion of the disk showing the circular arrangement of tooth elements, and also showing the wand tip in cross section and ghost lining engaged with one of the tooth elements.

With reference to the drawings and FIGS. 1 and 2 in particular, the toy 10 of the present invention comprises a disk 12 and a wand 14. The disk 12 has a circular rim 16, an axis of rotation suggested by the dotted line A—A, and a central dome 18 which defines a dome cavity 22 open to the underside of the disk and having an internal apex 20 aligned with the axis of rotation.

Figure 12:
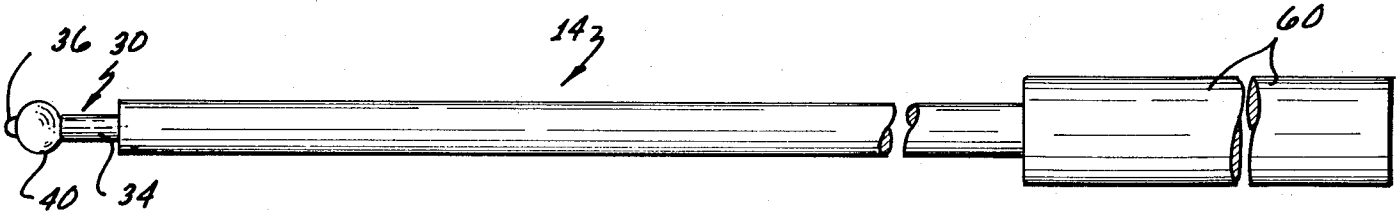
FIG. 12 shows the wand for use with the disk of FIGS. 1-3.

The wand 14 best seen in FIG. 12 may be a straight wooden rod of cylindrical cross section provided with a handle 60 at one end, and having a tip 30 which includes a length of reduced cross section 34, and an enlarged head 40 at the end of the section 34.

The disk is provided with a number of tooth elements 24, in this particular example there being five such tooth elements, disposed in a circular arrangement within the dome cavity 22 and extending radially inwardly from the circular dome wall 54 towards the axis of rotation AA. Each tooth element 24 has a leading edge 26 and a trailing edge 28. The trailing edge is oblique to the direction of rotation of the disk 12 so as to catch and positively engage the wand tip 30, (i.e., in effect pushed around in a circular motion by the tip 30 of the wand 14 so as to impart a spin to the disk 12). The leading edges 26 of the teeth 24 ramp or curve gradually towards the center of the disk so as to deflect and disengage the tip 30 of the wand when rotation of the disk 12 overtakes the motion of the wand tip and the tip ceases to push against a trailing edge 28. If the rotation of the disk 12 becomes faster than the circular motion of the tip 30, the tip 30 will fall back from the edge 28 and come into contact with the next following leading edge 26. Such contact merely results in the tip 30 being urged radially inwardly by the ramped leading edge (or the disk 12 being pushed away radially outwardly from the tip 30) without significantly slowing down the rotation of the disk 12. For this purpose, the leading edges 26 may be concavely curved with a radius of curvature which is relatively large as compared to the diameter of the wand tip 30. The shape of the leading edges 26 also provides a relatively large opening for easy entry of the tip 30 into engagement with the tooth 24. A semi-circular notch 32 is formed between each trailing edge and the leading edge of the next following tooth element, the notch 32 preferably closely conforms to the curvature of the portion 34 of reduced cross section of the wand tip 30. This notch provides for positive engagement of the wand tip with the disk 12. Once sufficient rotational momentum is imparted to the disk 12, the wand tip may be readily disengaged from the disk by slight radially inward movement of the wand tip, to thereby bring the wand tip out of the notch 12, after which the next following leading edge 26 may overtake the wand tip 30 and urge it away from the teeth 32 towards the center of the dome cavity 22.

Typically during such disengagement the disk 12 will drop until its weight is supported by the tip end 36 of the wand. The disk 12 then drops onto the trip end 36 of the wand 14 until the tip end 36 finds the apex 20 of the dome cavity, at which point the spinning disk 12 will be supported at its center by the end of the wand 14. The spinning disk 12 will maintain a gyroscopically stable position at the end of the wand 14 until friction with the wand tip and air slows down the disk and it begins to wobble. At that time the wand tip 30 may be re-engaged with one of the tooth elements 24 and the disk whirled about the wand tip to again impart rotational momentum to the disk. The end 36 of the wand tip 30 may be shaped to a small radius of curvature to thereby make low friction contact between the end 36 and the dome apex 20.

Figure 11:
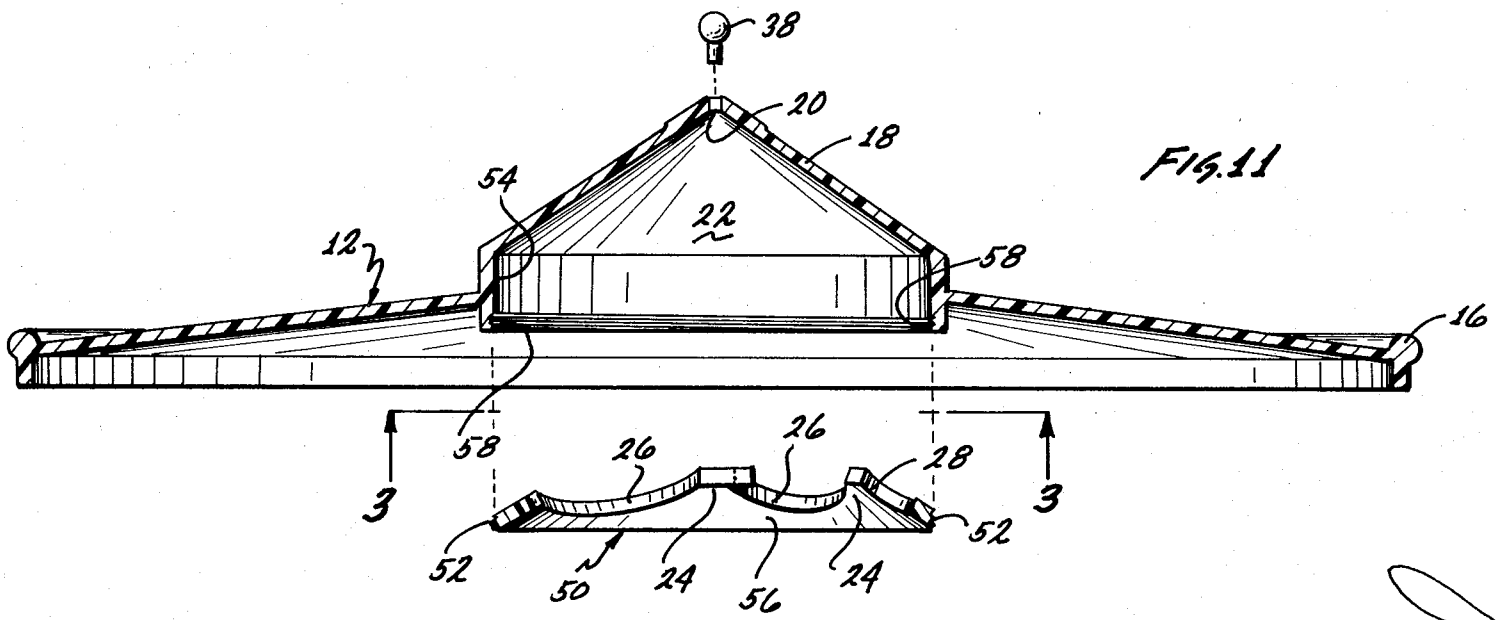
FIG. 11 is a cross section of the disk taken as in FIG. 2 showing the threaded tooth ring separated from this disk.

The dome 18 may take various shapes, including the concial shape illustrated in the drawings. The outer surface of the dome 18 may be provided with a dome tip 38 of relatively hard material, such as a metal stud fixed into a hole at the apex of the dome as best shown in FIG. 11 and provided with a rounded end. This dome tip 38 prevents excessive wear on the disk material when the disk is spun upside down on a surface, such as a ground surface, in the manner of a top, as illustrated in FIG. 4.

Each notch 32 of the tooth elements 24 is shaped and dimensioned to closely confrom to the cross sectional shape of the thinner portion 34 of the wand tip, such that the wand is locked against withdrawal from such engagement in a direction transverse to the plane occupied by the tooth ring 50, i.e., in a direction transverse to the plane of rotation of the disk 12. This locking engagement allows the disk to be spun, for example, upside down at the end of the wand tip 30. As a result, the disk 12 can be raised off the the ground from an initial position wherein the disk 12 is lying stationary upside down on a ground surface, as suggested in FIG. 4, and supported upside-down in mid-air as shown in FIG. 5, the disk being retained at the end of the down-turned wand while the disk is spun by the tip 30 of the wand. The disk may be further lifted without interrupting rotation of the disk to a position such as shown in FIG. 6, where the disk whirls about the wand tip 30 in a vertical plane and is held against the wand by centrifugal force generated by the eccentric spin of the disk about the wand tip.

Figure 10:
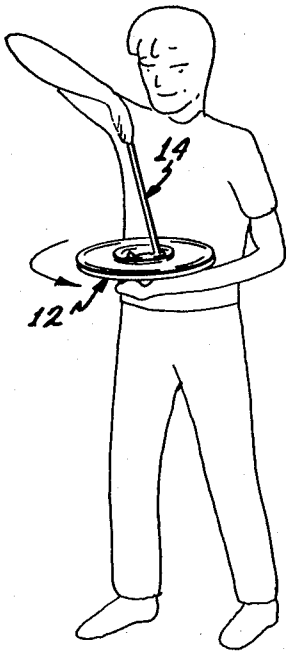
FIG. 10 illustrates the disk being spun upside down on the palm of a player's hand.

The disk may be further raised to a right side up position, such as shown in FIG. 7, without interrupting the whirling motion of the disk. The wand tip 30 may then be disengaged from the tooth element to allow the disk to seat onto the wand tip at its apex 20, the disk now spinning freely by inertia with the apex centered onto the wand end 36. The disk 12 may also be launched into the air by means of the wand, as suggested in FIG. 9, while still spinning, or may be spun upside down as a top in the palm of the player's hand as shown in FIG. 10. Still further, the spinning disk may also be thrown by one player along a flight path towards another player by means of the wand, for the other player to catch the disk at the end of a wand held by the receiving player without stopping the spinning motion of the disk. The disk may thus be passed between two or more players in a game of skill, which can be made as challenging and strenuous as desired.

Preferably, the tooth elements 24 are defined in a tooth ring 50 which has a threaded outer rim 52 threaded into threads 58 formed in cylindrical wall portion 54 of the dome 18 as shown in FIGS. 2 and 11. The tooth ring 50 desirably is generally frustoconical so as to present an inwardly tapering conical lower surface 56 which facilitates entry of the wand tip 30 into the interior space of the dome when catching the disk on the fly. The lower surface 56 typically may lie at approximately 33 degrees to the plane of rotation of the disk 12, although this angle is not critical and may be varied substantially.

While a preferred embodiment of the invention has been shown and illustrated for purpose of clarity, it will be understood that many changes, modifications and substitutions can be made by those skilled in the art to this embodiment without departing from the spirit and scope of the invention which is limited only by the following claims:

What is claimed is:

1. A toy comprising:

a free flying rotor body having an axis of rotation and provided with a plurality of tooth elements extending into a central aperture and disposed in a circular arrangement concentric with said axis of rotation, each said tooth element having a leading edge and a trailing edge; and a wand rod including a handle end and a wand tip;

said trailing tooth edges being engageably by said tip for transmitting movement of the wand tip through a circular trajectory to the rotor body thereby to impart a spin to said rotor body, said tip being disengageable from said tooth element by movement of said tip towards said axis of rotation, said wand tip being shaped for interlocking with said teeth against withdrawal in a direction transverse to the plane of said circular tooth arrangement during such engagement.

2. The toy of claim 1, the trailing edge of each tooth element defining a notch with the leading edge of the following tooth element for receiving the tip of said wand.

3. The toy of claim 2 wherein said wand tip end includes a portion of reduced thickness intermediate portions of greater thickness, said portion of reduced thickness being dimensioned to fit into said notch to thereby interlock the wand tip against withdrawal in a direction transverse to the plane of the circular tooth arrangement.

4. The toy of claim 1 wherein said rotor body has a top side and an underside and said central aperture opens into a central cavity including an apex in said underside shaped for receiving said wand tip such that the rotor body may be balanced for rotation on said wand tip.

5. The toy of claim 1 wherein said rotor body is disk shaped.

6. The toy of claim 5 wherein said disk has a central dome defining a dome cavity including an apex in said underside shaped for receiving said wand tip such that the rotor body may be balanced for rotation on said wand tip, and said tooth elements extend into said dome cavity.

7. The toy of claim 1 wherein said rotor body is constructed for relatively stable flight characteristics such that it may be spun by the wand and thrown along a flight path also by means of said wand.

8. The toy of claim 1 wherein said tooth elements are formed on a tooth ring attached to said disk shaped body.

9. The toy of claim 8 wherein said tooth ring is threadingly engaged to said disk shaped body.

10. The toy of claim 1 wherein said disk has a topside and an underside and is provided with a central tip on said topside to facilitate spinning of the disk shaped body upside down on a surface in the manner of a top.

11. The toy of claim 1 wherein said wand is a straight rod.

12. The toy of claim 1 wherein the tip end of wand said rod is tapered to a point having a relatively small radius of curvature.

13. The toy of claim 1 wherein said tooth elements are defined in a tooth ring, said ring being frustoconical and mounted within said concavity so as to present a ring surface sloping upwardly and inwardly towards said axis of rotation.

14. The toy of claim 13 wherein said sloping surface slopes at approximately 33 degrees relative to the plane of rotation of said disk shaped body.

15. The toy of claim 12 wherein said concavity has a threaded cylindrical wall portion and said tooth ring has a rim threaded for mating with said cylindrical wall portion.

16. A toy comprising:

a generally disk shaped body having an axis of rotation, a topside and an underside, a central dome on said topside defining a dome cavity open to said underside and including an apex in said dome cavity;

a plurality of tooth elements extending radially inwardly and disposed in a circular arrangement within said dome cavity concentrically with said axis of rotation;

each tooth element having a leading edge and a trailing edge, there being a notch defined between each trailing edge and the leading edge of the next following tooth element;

a straight wand having a handle end and a tip end, a portion of reduced thickness near said tip end engageable with any one of said notches so as to impart rotational momentum to said disk shaped body by circular movement of said wand tip, said wand tip being locked against withdrawal from said engagement in a direction transverse to the plane of rotation of said disk body by wand tip portions of greater thickness, said wand being disengageably from said notch by radially inward movement of the wand tip.

17. A toy comprising:

a generally disk shaped body having an axis of rotation, a topside and an underside, a centrally located concavity including an apex in said underside, a plurality of tooth elements extending radially inwardly and disposed in a circular arrangement within said concavity concentrically with said axis of rotation, each tooth element having a leading edge, a trailing edge and a notch defined between each said trailing edge and the leading edge of the next following tooth element; and a wand rod having a wand tip releasably engageable with the trailing edge of any one of said teeth for imparting a spin to said disk shaped body, said wand tip including a portion of reduced thickness dimensioned to fit into any one of said notches, said wand being locked against withdrawal from said notch in a direction transverse to the plane of said circular arrangement by wand portions of greater thickness.

18. The toy of claim 1 wherein said leading edges are shaped so as to allow disengagement of said wand tip from said tooth element upon cessation of moement of the wand tip through the said circular trajectory, thereby to allow continued free spinning of said rotor body.

19. The toy claim 18 wherein said central aperture opens into a dome cavity including a dome surface and an apex concentric with said axis of rotation, said dome surface guiding the wand tip into said apex so as to balance the spinning rotor body on said wand tip.

* * * * *